United States Patent [19]

Rhines et al.

[11] 4,126,935

[45] Nov. 28, 1978

[54] METHOD AND APPARATUS FOR MANUFACTURING WIRING HARNESSES

[75] Inventors: Warren J. Rhines, Convent Station; Arnold R. Smith, Chester, both of N.J.

[73] Assignee: Bell Telephone Laboratories, Incorporated, Murray Hill, N.J.

[21] Appl. No.: 801,586

[22] Filed: May 31, 1977

[51] Int. Cl.[2] ..... H01R 43/00

[52] U.S. Cl. ..... 29/628; 29/749

[58] Field of Search ..... 29/628, 749, 753, 566.3

[56] References Cited

U.S. PATENT DOCUMENTS

| | | | |
|---|---|---|---|
| 3,459,878 | 8/1969 | Gressitt et al. | 174/112 |
| 3,579,823 | 5/1971 | Gressitt | 29/630 |
| 3,836,415 | 9/1974 | Hilderbrandt | 156/296 |
| 3,842,496 | 10/1974 | Mercer | 29/624 |
| 3,846,896 | 11/1974 | Bakermans et al. | 29/749 |
| 3,859,724 | 1/1975 | Folkenroth | 29/628 |
| 3,885,287 | 5/1975 | Long et al. | 29/628 |
| 3,930,307 | 1/1976 | Schotthoefer | 29/628 |
| 3,967,356 | 7/1976 | Holt | 29/628 |
| 4,001,931 | 1/1977 | McKee | 29/749 |
| 4,060,890 | 12/1977 | Dechelette | 29/628 |

*Primary Examiner*—Michael J. Keenan

*Attorney, Agent, or Firm*—Robert O. Nimtz

[57] ABSTRACT

A method and apparatus for fully automatic fabrication of wiring harnesses is disclosed which is particularly suitable for twisted pairs of telephone wires. Such harnesses are fabricated using slotted-beam connector blocks for all terminations of the harness. Mass-termination to the slotted-beam connectors is accomplished with a pair-indexing head, a comb, and a presser head selectively terminating individual pairs of a bundle of pairs.

An automatic connector block insertion station, harness lashing station, and a pair-cutting station, distributed along a moving connector block holding belt, permit continuous automatic harness production.

19 Claims, 16 Drawing Figures

METHOD AND APPARATUS FOR MANUFACTURING WIRING HARNESSES

BACKGROUND OF THE INVENTION

1. Field of the invention

This invention relates to automatic fabrication of electrical wiring harnesses and, more particularly, to connectorized harness fabrication for twisted pairs.

2. Description of the Prior Art

The typical prior art method for fabricating wiring harnesses utilizes a peg board upon which individual wires are strung using the pegs for routing. When all the wires of the harness are arranged in a proper physical layout, lashing twine is used to secure the wire bundles in the various branches in order to maintain the physical configuration. Each wire end is separately stripped and each wire is color coded or marked to identify the proper termination point. The harness can then be taken off of the harness fabrication board and installed in the piece of electrical equipment for which it is intended. Finally, a craftsperson must attach each individual wire end to the proper terminal in the electrical appartus.

This technique for wiring electrical apparatus using prefabricated harnesses is slow, expensive, tedious, and usually results in a substantial number of wiring errors. Since the entire operation is manual, wire ends and individual wires must be indentified by a craftsperson during both fabrication and installation of the harness.

Flat cable harnesses in which the wires of the harness are fabricated in a continuous web together in a preselected orientation by insulation bridges between the various wires reduces some of these problems. An operator is still required, however, to identify and handle each of the wires in order to install the harness.

It is sometimes desirable in such prior art harness-making systems to attach connector blocks of some sort to the ends of the wires in order to simplify the installation procedure. Although such connector blocks reduce the labor involved in installing the harness, the same labor is merely transferred to the harness-making station since the individual ends of the wires must be indentified in order to attach them to the connector block. One such system is shown in P. W. Mercer U.S. Pat. No. 3,842,496, granted Oct. 22, 1974. A similar technique, using a flat cable harness, is shown in L. H. Hilderbrandt U.S. Pat. No. 3,836,415, granted Sept. 17, 1974. Yet other connectorized harness fabrication systems are shown in E. E. Folkenroth U.S. Pat. No. 3,859,724, granted Jan. 14, 1975, and R. A. Long et al U.S. Pat. No. 3,885,287, granted May 27, 1975.

Each of these prior art harness-making systems involve considerable manual manipulation of the harness parts and connector blocks and none is suitable for twisted pairs of telephone wires.

SUMMARY OF THE INVENTION

In accordance with the illustrative embodiment of the present invention, electrical harness fabrication with twisted telephone pairs is accomplished on a continuous and fully automatic basis using a pair-indexing head, quick connect connector blocks, and a mass-terminating wire connection mechanism for selectively inserting indexed wire pairs into the connector block. Connector blocks are presented to the mass-terminating station in a continuous fashion on a moving belt. A connector block insertion station upstream from the mass-terminating station insures a continuous supply of connector blocks.

A harness lashing station downstream from the mass-terminating station automatically lashes the wire bundles so as to facilitate proper branching of the bundles as well as to maintain the bundle integrity. A final wire cutting station cuts the wires at each terminal block to separate the continuous stream of wires and connector blocks into discrete wiring harnesses.

It will be noted that the entire fabrication process described above, from wire spools and connector block supply to finished harnesses, is entirely automatic, thus minimizing the possibility of wiring errors. The pair-indexing head permits this automatic fabrication technique to be applied to twisted pairs of wires. Finally, none of the wires need have any color coding or other indentification since their proper interconnection with connector terminals in the connector blocks is assured by the automatic process.

In order to install such a harness, it is merely necessary to mate the connector blocks of the harness with appropriate connector blocks in the electrical apparatus. Moreover, such harnesses can be easily stocked as spares to be used for replacing worn-out or defective harnesses previously installed. Wiring harnesses made in this fashion can be fabricated much faster than in prior art systems and, at the same time, with wiring errors substantially eliminated. While the harness fabrication system of the present invention is particularly suitable for twisted pairs, obvious modifications will render the system equally suitable for single insulated wires.

DETAILED DESCRIPTION

Figure 1:
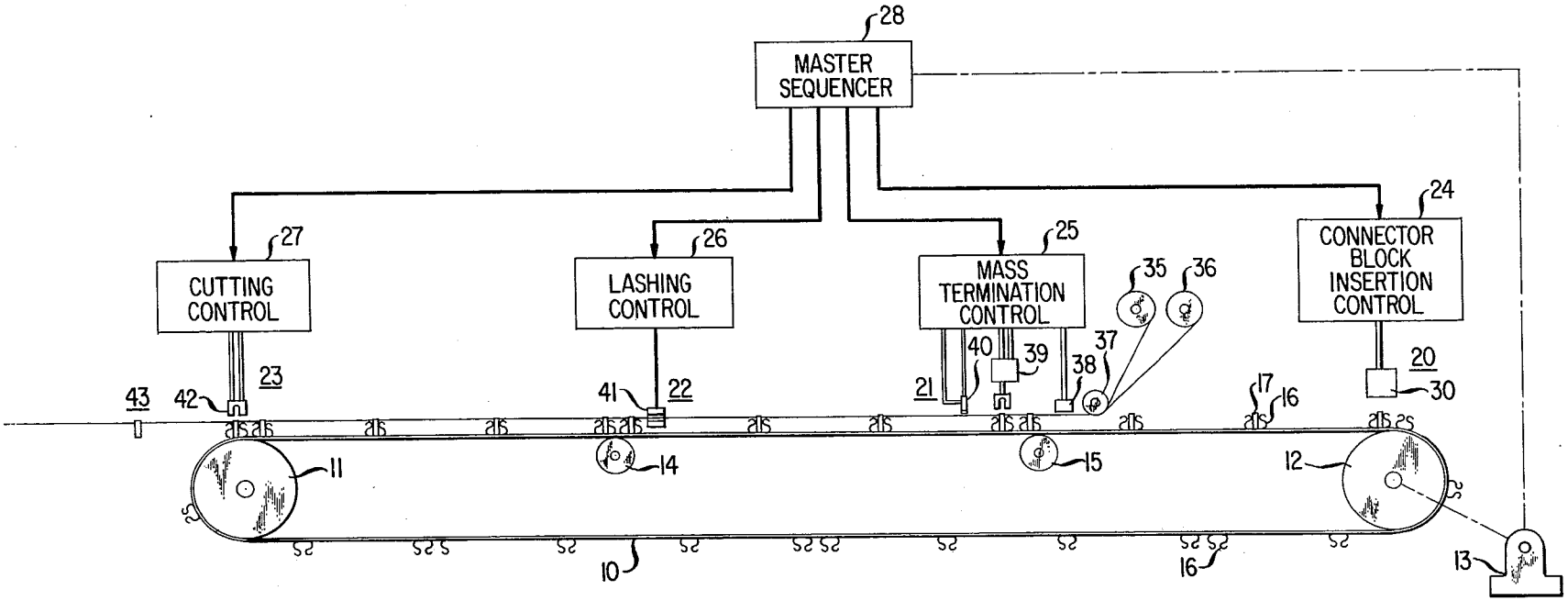
FIG. 1 is a general schematic diagram of a harness manufacturing apparatus in accordance with the present invention.

Referring more particularly to FIG. 1, there is shown an overall view of a harness fabrication apparatus utilizing the principles of the present invention. The apparatus of FIG. 1 comprises a continuous belt 10 wound around an idler drum 11 and a driver drum 12. Driving motor 13 rotates driver drum 12 to cause belt 10 to move around drums 11 and 12 in a counterclockwise direction. Rollers 14 and 15 assist in supporting belt 10 in areas immediately beneath the fabrication stations. Rollers 14 and 15 are merely illustrative of this type of roller support and numerous other rollers may be provided, as required, to maintain belt 10 in a reasonably flat and level position.

Affixed to belt 10 are a plurality of holding devices 16, which in FIG. 1, are illustrated as being metal clamps suitable for grasping and holding electrical connector blocks 17. Holding devices 16 may be fashioned in any manner suitable for providing the function of holding connector blocks similar to connector block 17 in an upright position at properly spaced intervals. To this end, the position of holding devices 16 can be adjusted to correspond to the relative positions of the terminations of the resulting wiring harnesses. The particular positions illustrated in FIG. 1 correspond to a particular wiring harness shown in more detail in FIGS. 2 and 3

Suspended above moving belt 10 are a plurality of fabrication stations including insertion station 20, terminating station 21, lashing station 22, and cutting station 23. Together, these four stations, 20 through 23, perform all of the operations necessary to fabricate wiring harnesses in a continuous and automatic fashion. Motor 13 causes drum 12 to rotate and advance the connector block holding devices 16 from station to station along the upper surface of moving belt 10. In accordance with the preferred embodiment of the invention, motor 13 is turned off at regular intervals so as to stop belt 10 when each of connector block holding devices 16 is located under one of the operating stations 20, 21, 22, and 23. Indeed, with the spacing of stations 20 through 23 shown in FIG. 1, a connector block holding device 16 will be disposed beneath each of the stations 20 through 23 when belt 10 stops, at which time appropriate operations can be simultaneously carried out at each of these stations. These operations will, of course, be performed on identical, but different, wiring harnesses and this way a sequence of identical harnesses can be fabricated on the apparatus of FIG. 1 without human intervention.

Each of stations 20 through 23 is controlled in a manner to be described by control devices 24, 25, 26, and 27, respectively. The control devices 24 through 27 may be entirely mechanical, consisting of cams, lever arms, and gear driving equipment; may be entirely electrical, consisting of soleniods, driving circuitry, and solenoid driven pistons for performing the mechanical operations; or may comprise hydraulic or pneumatic mechanisms or any combination of these schemes. In the balance of the present disclosure it will be assumed that appropriate reciprocal motions are imparted to the various portions of the apparatus of FIG. 1 by such means and only the operating portions of the apparatus will be shown in detail.

A master sequencer 28 is used to control motor 13 as well as each of the station controls 24, 25, 26, and 27. Sequencer 28 insures the coordinated movement on the belt 10 and the operations of the various apparatus at stations 20 through 23. Again, master sequencer 28 may be an electrical sequencer to drive electrical and electronic control equipment or may be a mechanical sequencer consisting of cams and cam followers mounted on the same or coupled shafts to insure the proper timing of the various operations.

At insertion station 20, insertion control 24 is utilized to control an insertion tool 30 which inserts a connector block 17 into each of connector block holding devices 16 as these holding devices come into position under tool 30 under the control of motor 13 and the movement of belt 10. Connector blocks 17 are supplied to insertion tool 30 in a continuous fashion and may be of various sizes but preferably are of identical cross-section. Size variations of the connector blocks are required so that different numbers of wires can be connected to each of the connector blocks.

At mass-terminating station 21, a supply of electrical wires, which may be twisted pairs, are supplied by supply reels 35 and 36. Supply reels 35 and 36 are merely illustrative of the supply reels which must be provided, one for each wire or wire pair to be used in the wiring harness being fabricated. These wires are fed around alignment pulleys 37 to a pair indexing head 38. Indexing head 38 is adapted to remove the twist in twisted pairs of wires and to align the members of the pair in a common plane to permit mass-termination. Such mass-termination is accomplished with a mass-terminating head 39 which, as will be described hereinafter, presses the individual wires from index head 38 into quick connect terminals on terminal block 17. These connectors complete electrical circuits from the wires to the connector blocks and at the same time provide a mechanical attachment of wires to the connector blocks. A reciprocating comb structure 40, in cooperation with index head 38, serves to remove the twists in the wires between index head 38 and comb 40 in order to permit such mass-terminations.

At lashing station 22, a lashing tool 41, controlled by element 26, provides a single tie around any preselected members of the wires supplied from reels 35 and 36. Thus lasher 41 is controlled in its lateral movement so as to tie together any preselected number of adjacent wires. This lashing function serves to tie the wire together in bundles to form the harness and is also used to locate the branching points of the harness where it is necessary to separate a plurality of wires for different routing.

At cutting station 23, a cutting head 42, under the control of element 27, slectively cuts the wires at each of the connector blocks 17. Cutting head 42 can be adjustably controlled to cut the wires on either the left- or the right-hand side of the connector block. This cutting operation is useful in disposing of unused portions of the wire and can also be used to separate the wiring harnesses from each other following the continuous fabrication process. In area 43, completed wiring harnesses can be taken from belt 10 by removing the individual connector blocks from their holding devices 16. Wiring harnesses are immediately ready for installation or may be further lashed and stored for future use. Indeed, the wires between different harnesses need not be cut at cutting station 23 but retained to hold the harnesses together so that a continuous supply of harnesses is available to an automatic harness insertion process which is not described herein. Of course, in this case the final cutting operation must take place at a later time to separate the harnesses.

It can be seen that the entire harness fabrication process illustrated by the apparatus in FIG. 1 is continuous and fully automatic. Coordinated operations under the control of master sequencer 28 and individual controls 24 through 27 render the process continuous and automatic. Moreover, the process includes only four major operations: insertion, mass-termination, lashing, and cutting, taking place at stations 20, 21, 22, and 23, respectively. The tools at these various stations will be described in detail hereinafter in connection with the balance of the Figures, Referring first to FIG. 2, there is shown a schematic picture of a single harness in the process of manufacture. Each horizontal line represents a single wire or a twisted pair of wires, depending on which is used in the harness. Connector blocks 50, 51, 52, and 53 are mounted on belt 10 in holding devices similar to holding devices 16 in FIG. 1. For the purposes of illustration, a harness as shown in FIG. 3 with four terminations will be described.

Figure 3:
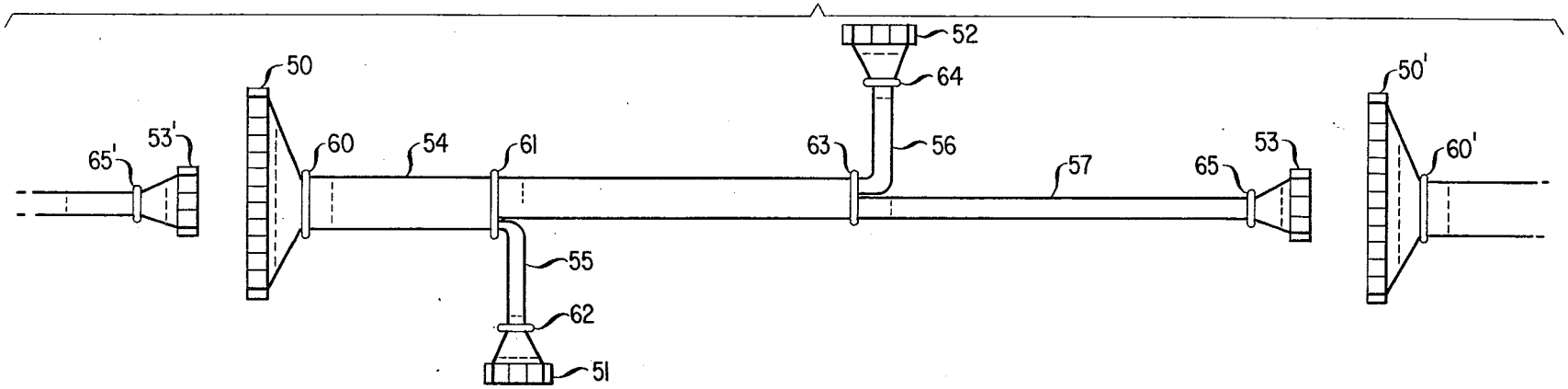
FIG. 3 is a graphical representation of a harness made in accordance with the method and apparatus of the present invention.

In FIG. 3, the central bundle of wires 54 connected to connector block 50 is subdivided into branches including branch 55 terminated by connector block 51, branch 56 terminated by connector block 52, and branch 57 terminated by connector block 53. Connector block 50′ represents the first connector corresponding to connector block 50 of the next succeeding harness. Similarly, connector block 53′ corresponding to connector block 53, represents the last connector of the next preceding wiring harness. As shown in FIG. 3, lashing ties 60, 61, 62, 63, 64, and 65 serve to collect the wires of the bundle at each of the connector blocks 50 through 53 and in the case of ties 61 and 63, control the branching points for the various branches 55, 56, and 57.

Assuming that connector blocks of appropriate size and position have been placed on belt 10, the mass-terminating station 21 in FIG. 1 connects all of the wires (12 in the illustrative example) to connector block 50. The lower four wires, in turn, are terminated at connector block 51, the upper four are terminated at connector block 52, and the middle four are terminated at connector block 53. These numbers of wires have been selected only for the purposes of simplifying the description. As will be apparent, any number of connectors and any number of wires can be accommodated in accordance with the principles of the present invention.

Figure 2:
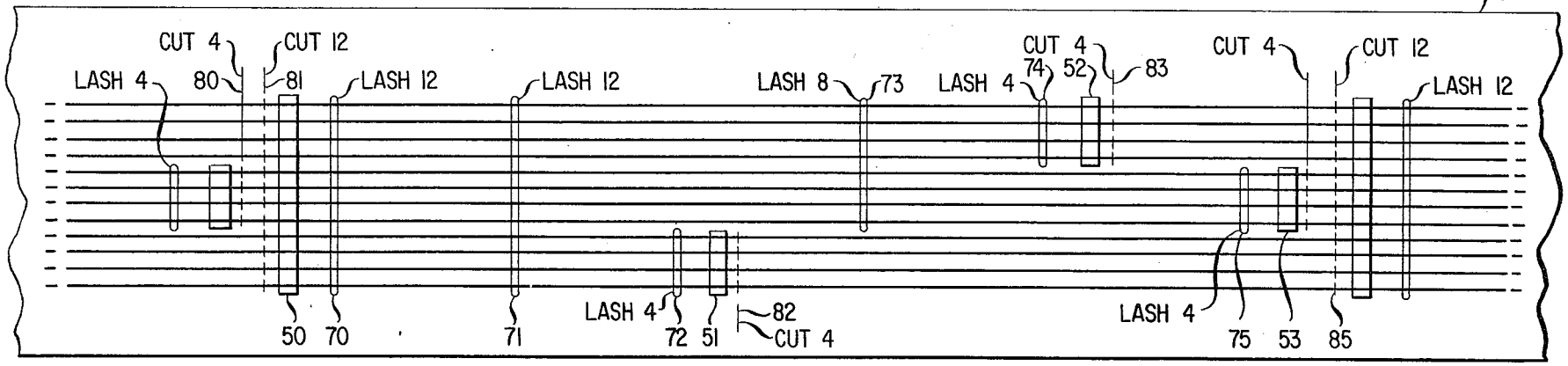
FIG. 2 is a graphical representation of the connectors and wires of a typical harness during the process of fabrication.

At the lashing station 22 of FIG. 1, ties are placed at positions 70, 71, 72, 73, 74, and 75, resulting in the gathering of the bundle at points 60 through 65, respectively, as shown in FIG. 3. Finally, the various wires are cut at points 80 through 85, as illustrated in FIG. 2. As will be readily apparent, cutting the wires at these places permits unused portions of the wires to be discarded and also serves to separate the successive wiring harnesses from each other. It will be noted, for example, that if the center four wires at positions 80 and 81 are not cut, the four wires can be used to hold successive harnesses together for easy storage or for feeding into yet a different automatic process. The similar cut of the center four wires at location 84 and 85 serve the same purpose between the next two wiring harnesses.

It can also be seen that the connector blocks must be located on moving belt 10 in positions which correspond precisely to the desired resulting configuration of the wiring harness. Thus, for example, the spacing between connector blocks 50 and 51 is equal to the combined lengths of branches 54 and 55. The spacings of the various other connectors are similarly related to the dispositions of the connector block in the resulting wiring harness.

Finally, it will be noted that only the lasher ties 60 through 65 are applied automatically in the apparatus of FIG. 1. Further tieing of the bundle, as shown in FIG. 3, can be accomplished separately if it is necessary to maintain the integrity of the wire bundles. In many applications, however, such further lashing will not be required and the ties 60 through 65 will be adequate to insure the proper positioning and routing of the various portions of the harness.

Figure 4B:
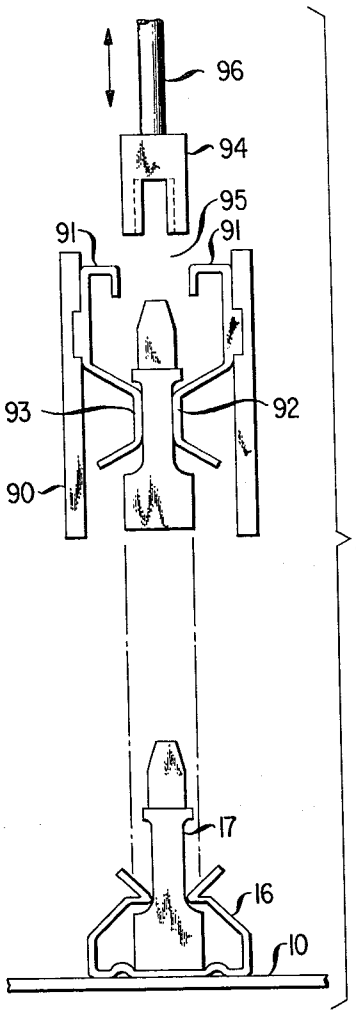
FIGS. 4A and 4B are elevation and cross-sectional views, respectively, of a connector block inserting tool which might be used in the fabrication apparatus of FIG. 1.
Figure 4A:
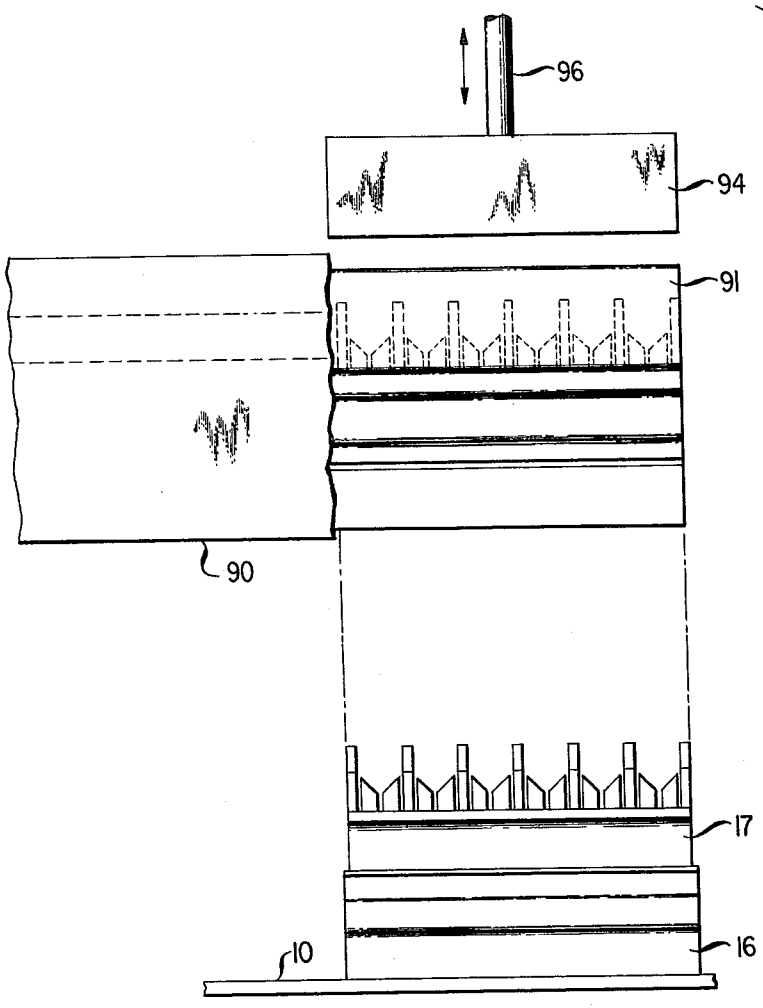

In FIG. 4A there is shown an elevation view of the connector block insertion station. Shown for reference purposes in FIG. 4A is a cross-section of the moving belt 10, one of the connector block holding devices 16, and a connector block 17 positioned in the holding device 16. The station itself includes a magazine 90 of any desired length which holds a plurality of connector blocks 17 in end-to-end relationship and adapted to be fed through magazine 90 from left to right under the urging of an advancing mechanism, not shown. At the right-most end of magazine 90 is an open connector block clamp 91 which can be better seen in cross-section in FIG. 4B.

FIG. 4B is a cross-sectional view of clamp 91 having a connector block 17 held resiliently in an upright position between spring arms 92 and 93. A presser head 94, located above clamp 91, is dimensioned to fit through a slot 95 in the top of holder 91 and to engage the top of connector block 17. When so engaged, presser 94 pushes connector block 17 out of the grasp of spring arms 92 and 93 and down into connector block holding device 16. When presser head 94 is thereafter raised, terminal block 17 remains engaged by holder 16 and clamp 91 has been emptied to make way for the next connector block in magazine 90.

It will be noted, particularly in connection with FIG. 2, that the size and locations of the various connector blocks may be advantageously varied across the width of belt 10 in order to accommodate the harness configuration. This can be accomplished by loading magazine 90 with an appropriate sequence of connector blocks positioned by spacers so that when advanced into clamp 91, they will be properly positioned with respect to belt 10.

Presser head 94 is shown with an actuating arm 96 which is lowered and raised for each insertion operation. The lowering and raising of head 94 is synchronized with the advancement of connector blocks in magazine 90 and with the movement of belt 10 so that a connector block of proper size is inserted in each of connector block holding devices 16 on belt 10. The motion of head 94 can be controlled by mechanical or electrical, or a combined electromechanical control system, which has been omitted for the purposes of simplicity.

Connector block magazine 90 may be removable so that a plurality of loaded magazines can be attached to the insertion station in sequence as required. Alternatively, an automatic feeder mechanism for each of the various sized connector blocks can be provided to feed magazine 90 with connector blocks in the appropriate sequence. Since this feeder mechanism forms no part of the present invention, it has not been illustrated in the drawings.

Figure 5:
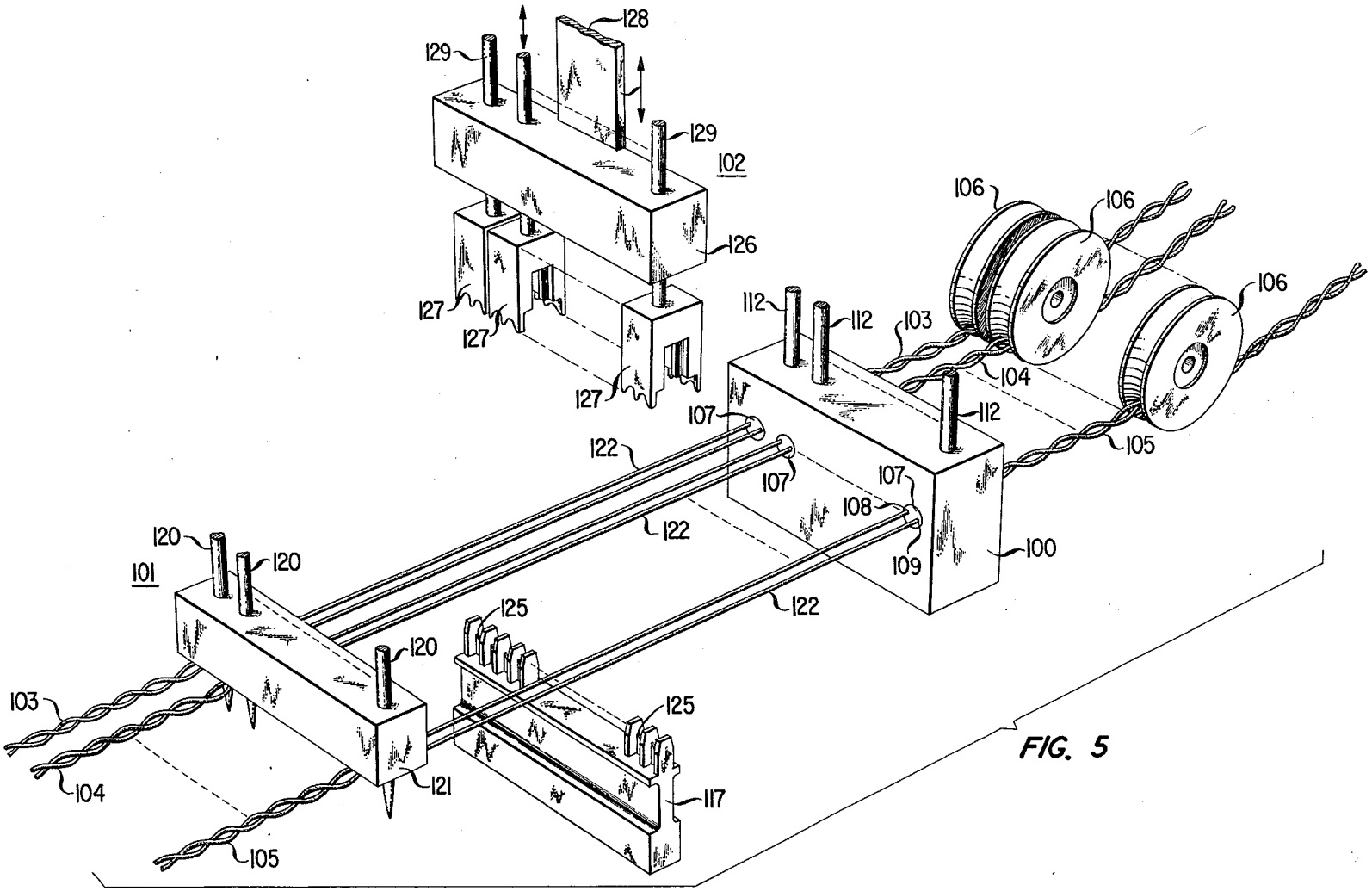
FIG. 5 is a perspective and partially exploded view of a mass-terminating station which may be used in the fabrication apparatus of FIG. 1.

In FIG. 5 there is shown a mass-terminating station comprising a pair-indexing head 100, a comb structure 101, and a presser head assembly 102. Twisted pairs of insulated wires 103, 104, and 105 are supplied from supply reels, not shown in FIG. 5, around guide pulleys similar to pulley 106 so as to feed horizontally into pair-indexing head 100. Pulleys 106 are free to rotate on their central axes to permit the twisted pairs to be fed in properly spaced relationship from the supply reels to indexing head 100.

Indexing head 100 includes a plurality of rotors 107, each of which includes a pair of threadways, such as threadways 108 and 109, through which the individual wires of a pair are threaded. The rotors 107 are shown more clearly in the detailed perspective cut-away view of FIG. 6.

Figure 6:
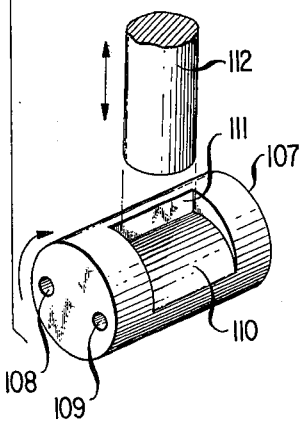
FIG. 6 is a detailed prespective view of the rotor latching mechanism useful in the pair indexing head of FIG. 5.

Referring then to FIG. 6, the rotor 107 is supported in indexing head 12 by precision bearings (not shown) which permit rotor 107 to rotate freely with low friction in indexing head 12. Thus, when individual wires of the twisted pair are threaded through threadways 108 and 109, rotor 107 is free to rotate and track the twist in the twisted pair.

The rotor 107 in FIG. 6 also includes a ramp 110 cut into the side of the rotor cylinder and which ends abruptly at a stop 111. The plane of stop 111 bears a known relationship to the axes of threadways 108 and 109 and, indeed, is midway therebetween and perpendicular thereto. A lock pin 112 is mounted in indexing head 12 for sliding movement toward and away from rotor 107. When actuated in a downward direction, lock pin 112 engages ramp 110 and under the influence of the clockwise rotation of rotor 107, eventually engages stop 111 and prevents further rotation of rotor 107. If individual wires are used instead of twisted pairs, rotors 107 can be locked permanently and the threadways used only to orient the single wires.

Returning to FIG. 5, it can be seen that the rotors 107 track the twists in twisted pairs 103 through 105 until the lock pins 112 are depressed. At that time, each of lock pins 112 engages a respective one of rotors 108 and prevents further rotation. At this time, the two conductors of each twisted pair are oriented in a common plane and at a preselected sequence between the wires of each twisted pair. A twisted pair indexing mechanism suitable for indexing head 100 is disclosed in T. J. Gressitt U.S. Pat. No. 3,579,823, granted May 25, 1971.

Figure 7:
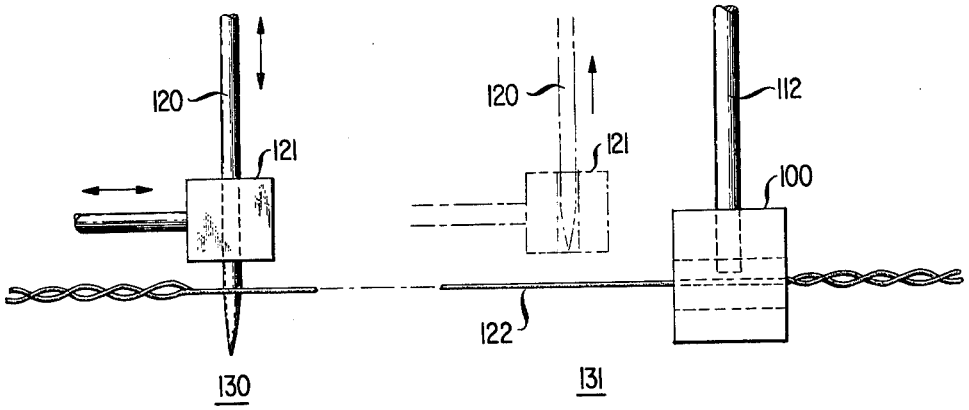
FIG. 7 is a detailed elevation view of the wire combing apparatus used in the mass-terminating station of FIG. 5.

Comb structure 101 is provided with a plurality of equally spaced teeth 120 which are spaced to fit conveniently between the threadways 108 and 109 of each of rotors 107 and between the threadways of adjacent rotors in indexing head 100. Thus, when teeth 120 are raised so that the lower ends of teeth 120 clear twisted pairs 103 through 105, the comb head 121 is moved upstream to a position adjacent to indexing head 100, as shown in FIG. 7. At this time, the teeth 120 are lowered and will fit between the adjacent wires exiting from indexing head 100. Latching pins 112 are lowered to latch rotors 107. As comb head 121, with teeth 120 lowered, is subsequently pulled away from indexing head 100, the spatial separation and orientation of each of the wires 122 in the space between indexing head 100 and comb head 121 will be maintained as shown in FIG. 5.

It will be noted that, in the area downstream from comb head 121, the pairs 103, 104, and 105 again assume a twisted configuration since the normal twist in these pairs has been allowed to pass through indexing head 100 by the rotation of rotors 107. The untwisted and planar configuration of the wires 122 extends only between indexing head 100 and comb head 121 and persists only so long as the latch pins 112 are in a lowered position engaging the rotors 107.

Between indexing head 100 and comb head 121 is a connector block 17 and a presser assembly 102, shown in exploded positions in FIG. 5. Connector block 17 is held in a holding device, not illustrated in FIG. 5, but which is shown as holding device 16 in FIGS. 1 and 4B. Connector block 17 is thereby held in an upright position so that a plurality of slotted beam connectors 125 located in channels in the top of connector 17 are oriented in upward direction, facing wires 122.

Presser assembly 102 comprises a presser-carrier block 126 and a plurality of presser heads 127. Carrier block 126 can be raised and lowered with an actuating arm 128 while each of presser heads 127 can be separately and independently raised and lowered by means of actuating arms 129. Thus carrier block 126 can be raised to withdraw the entire presser assembly 102 away from wires 122 while comb 101 is separating the wires of the twisted pairs. When such separation is completed, carrier head 126 can be lowered so that presser heads 127 are in close proximity to the wires 122. Finally, each of presser heads 127 can be independently lowered still further, away from carrier head 126, by means of actuating arms 129. When so lowered, each of presser heads 127 forces one pair of wires 122 into adjacent slotted beam connectors 125 in connector block 17. Connections are not made for those pairs of wires for which the presser head 127 is retained in the retracted or uppermost position.

The operation of the various portions of mass-terminating station in FIG. 5 can be better understood with references to FIGS. 7 through 11.

In FIG. 7 there is shown an elevation view of the comb 101 and its relationship to indexing head 100. Thus, in FIG. 7, the comb head 121 is shown in position 130 with the teeth 120 extended in a downward direction and engaging wires 122. At position 131, on the other hand, where the comb structure 101 is shown in dotted outline, the teeth 120 are shown withdrawn so as to clear the tops of wires 122. At position 131, the teeth 120 can again be lowered to extend through wires 122 and thus engage the twists in these wires. When head 121 is then moved to the left, back to position 130, the twists in the twisted pairs are removed as shown in FIG. 5. It is clear, of course, that latch pins 112 must be lowered into indexing head 100 in order to engage rotors 107 and prevent their rotation before comb head 121 can be moved to the left. This cooperation of the teeth 120 and the rotors 107 is utilized to remove the twists from the twisted pairs for the short length of wires between heads 121 and 100, solely for the purpose of aligning the individual wires of the pair to permit mass-termination in a connector block. Once this mass-termination is completed, teeth 120 may again be withdrawn to allow the connector blocks and attached twisted pairs to move to the next operating station.

Figure 8:
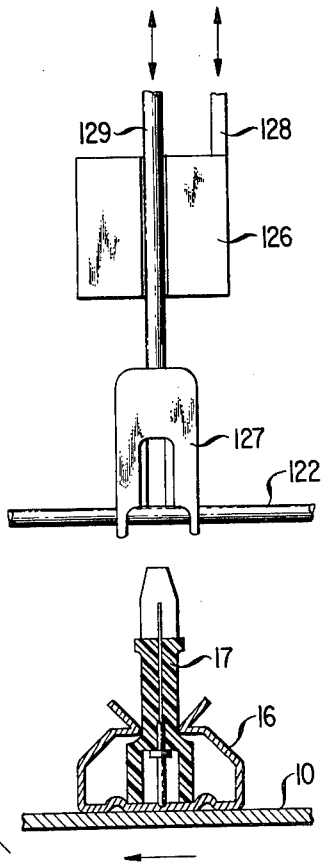
FIG. 8 is an elevation view of the presser head used in the mass-terminating station of FIG. 5.

Turning to FIG. 8, there is shown a partial sectional elevation view of the presser assembly 102. As can be seen in FIG. 8, with the presser head carrier block 126 in a lowered position, the presser head 127 can be further lowered by means of actuating arm 127 to engage wires 122 and, upon yet further depression of arm 129, force wires 122 into the slotted beam connectors at the top of connector block 17.

Figure 10:
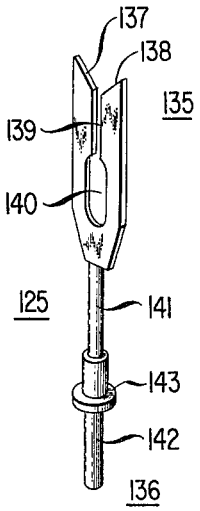
FIG. 10 is a perspective view of a connector which might be used with the connector block shown in FIG. 5.

In FIG. 10 there is shown a single slotted beam connector 125 in a detailed perspective view. Connector 125 includes slotted beam end 135 and a pin connector end 136. The slotted beam end 135 includes beveled and tapered ends or beams 137 and 138 which are formed by a coining trim tool into sharp insulation-piercing edges. A slot 139 receives and grips a wire forced therein. The two ends of beams 137 and 138 are separated by an elongated and widened slot 140 to permit beams 137 and 138 to move resiliently and grasp the conductor of an insulated wire at slot 139 by means of spring action. The slotted beam end 135 of connector 125 is connected through a stem portion 141 to a pin connector end 136 designed to permit electrical contact between a pin 142 and a mating receptacle (not shown) in a mating connector block. Shoulder 143 at the pin connector end 136 of connector 125 serves to hold the connector 125 in proper relationship to the body of connector block 17, as is shown in FIG. 8.

Figure 9:
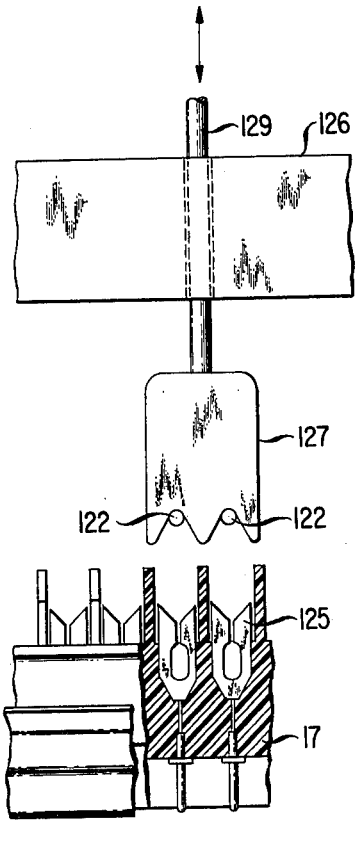
FIG. 9 is a partial cross-sectional view of the presser head of FIG. 8.

In FIG. 9 there is shown another partially sectioned elevation view of the presser head assembly. In FIG. 9 it can be seen that each of presser heads 127 engage two of insulated conductors 122, the two being the two members of a single twisted pair. When presser head 126 is lowered, wires 122 are forced between the tapered ends 137 and 138 (FIG. 10) of connectors 125, cutting through the insulation around the central conductor. Further lowering of head 127 forces the conductor at the center of insulated wires 122 into slots 139 where a low resistance electrical connection is made to the central conductor.

Figure 11:
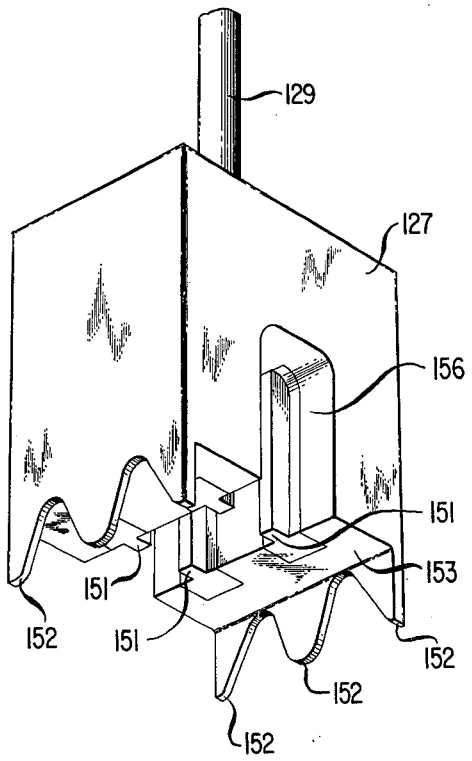
FIG. 11 is a detailed perspective view of a portion of the presser head shown in FIGS. 8 and 9.

A perspective view of the pair presser head 127 is shown in FIG. 11. The bottom of presser head 127 has a longitudinal slot 156 cut therein of sufficient width and depth to fit over the upper portion of connector block 17 without engaging any portion of the connector block. A plurality of guides 151 projecting from the vertical inner walls of slot 150 are dimensioned and positioned to engage respective ones of the channels in the top of connector block 17 in which the connectors 125 are located. That is, opposing guides 151 engage opposite sides of the channels in terminal block 17 when head 127 is lowered. At the same time, teeth 152 guide wires 122 so that the bearing surfaces 153 and 154 engage each of the wires 122 and force it down into the slots 139 in connectors 125 of connector block 17. Guides 151 insure the precise alignment of the head 127 with the slots 139.

Figure 12:
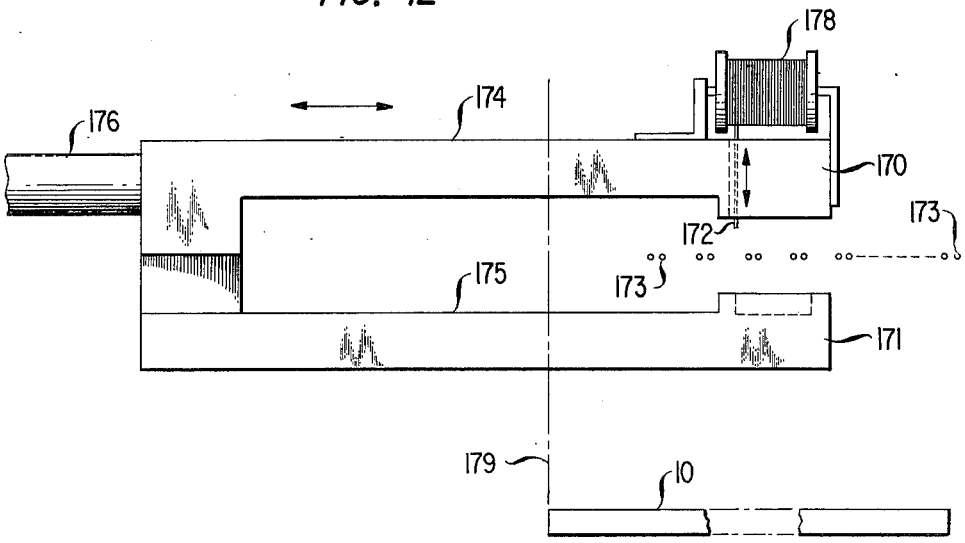
FIG. 12 is an elevation view of a lashing tool useful in the fabrication apparatus of FIG. 1.

In FIG. 12 there is shown a lasher 41 including a horizontally moving carrier 176 having an upper arm 174 and a lower arm 175. Arms 174 and 175 are arranged to extend above and below, respectively, the wire pairs 173 shown in cross-section FIG. 12. The moving belt 10 below wire pairs 173 is also shown in cross-section in FIG. 12. Carrier 176 is driven by a stepping motor 177 from a home position 179, where it clears the edge of belt 10, to any one of a plurality of positions between the various pairs 173 of electrical conductors. A lashing head 170 is carried on the upper arm 174 and utilizes a source of lashing twine 178 and a movable cord carrier 172. Carrier 172, under the control of sequencing signals from lashing control 26 (FIG. 1), extends the lashing twine to a lower lashing head 171 where it is picked up so that, as carrier 176 is moved back to the left, the lashing twine encircles all the wire pairs 173 to the left of cord carrier 172. When carrier 176 is retracted to the left, it encloses wire pairs 173 in sequence and can be stopped at any position to the left of its initial position. Upper lashing head 170 and lower lashing head 171 can then cooperate to tie off and cut the lashing cord encircling the preselected wire pairs. Thereafter, carrier 176 is again moved to the left and returned to the home position 179.

It can be seen that lasher 41 can lash any adjacent subplurality of wire pairs 173 and, in particular, can provide the lashing ties 60, 61, 62, 63, 64, and 65 shown in FIG. 3. The lasher 41 operates somewhat like an automatic sewing machine but provides only a single tie at a selected position on the wiring harness. This tieing action can then be repeated by moving belt 10, together with wire pairs 173, to a new location and reactivating carrier 176 by means of stepping motor 177.

Although the lasher 41 is shown in FIG. 12 as utilizing a spool 178 of lashing twine, alternatively, the lashing heads 170 and 171 can be designed to utilize plastic locking strips. In this arrangement, a serrated end of the locking strip is inserted through an aperture in the other end which automatically locks on one of the serrations. Other configurations for lasher 41 will be readily apparent to those skilled in the art and any one of these alternatives is suitable for use with the present invention if it provides the essential function of tieing any preselected subplurality of adjacent wire pairs together at a specific point.

Figure 13:
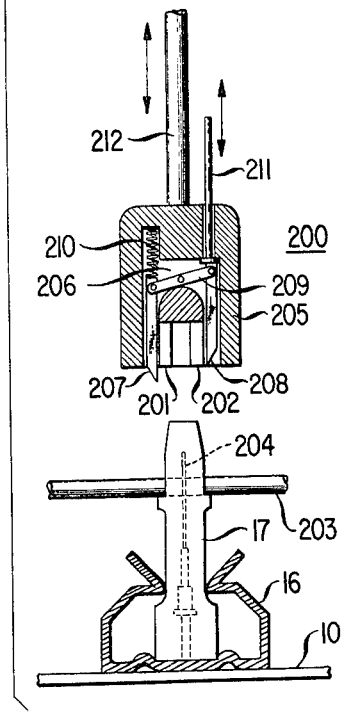
FIG. 13 is an elevation view in partial cross-section of a cutter head useful in the fabrication of FIG. 1.

In FIG. 13 there is shown a detailed cross-sectional view of a wire cutting head suitable for use as head 42 in FIG. 1. The cutting head 200 shown in cross-section FIG. 13 has a pair of extensions 201 and 202 which are designed similarly to extensions 151 in FIG. 11 to fit into the slots at the top of connector block 17. Connector block 17 is again shown in FIG. 13, held in position by a connector block holding device 16 mounted on belt 10. It can be seen in FIG. 13 that the insulated electrical conductors 203 are secured in slotted beam connectors 204 in the manner shown in FIGS. 8 through 11.

Included within cutter head 200 is a body 205 having an inner chamber 206 in which is mounted a pair of cutting blades 207 and 208 attached to a pivot bar 209. Pivot bar 209 is adapted to pivot around its central axis under the control of a spring 210 and an actuating arm 211 to extend and retract cutters 207 and 208. Blades 207 and 208 serve to sever wires 203 on either the left- or the right-hand side of connector 204.

In operation, cutter head 200 is lowered by way of arm 212 until extensions 201 and 202 engage the top of connector block 17. At this time, one of the cutting blades 207 in FIG. 13 engages and severs wires 203. After this cutting operation, cutter head 200 is again raised and belt 10 moved to the left to present the next connector block 17 to cutter head 200.

Actuating arm 211 can be lowered to operate pivot arm 209 against the tension of spring 210 and extend blade 208 beyond the bottom edge of head 200. At the same time, blade 207 will be retracted into its channel and, when cutter head 200 is lowered, the wire 203 will be cut on the right-hand side of terminal block 17 rather than on the left side. This arrangement permits selective cutting on either the right- or the left-hand side of the connector block as is required by the topology illustrated in FIG. 2.

Figure 14:
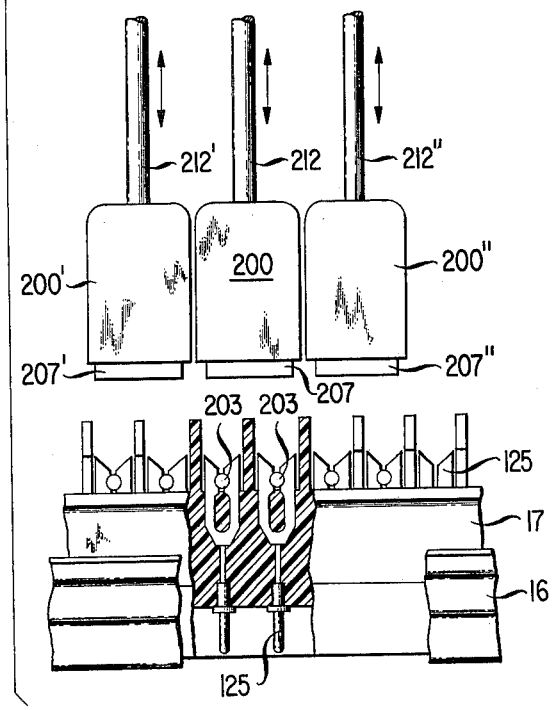
FIG. 14 is another partial cross-section elevation view of the cutter head shown in FIG. 13.

In FIG. 14 there is shown another view of the cutter head 200 and also showing cutter heads 200, 200', and 200'' having extended cutting blades 207, 207', and 207'', respectively. All three cutter heads can be individually lowered by their respective operating arms 212, 212', and 212''. It will be noted that each of the cutter heads is dimensioned so that the corresponding cutter blade engages two adjacent wires 203 in adjacent connectors 125. These two wires are the members of a common pair and are always cut, as well as placed, as a pair.

Figure 15:
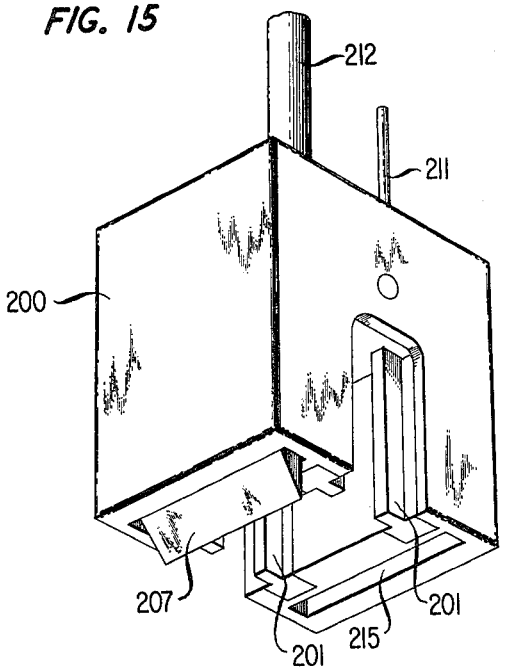
FIG. 15 is a detailed perspective view of a portion of the cutter head shown in FIGS. 13 and 14.

FIG. 15 shows yet another view of cutter head 200 showing extensions 201 and 202, blade 207, and a recess 215 in which blade 208 is retracted.

It will be noted that each of the operating stations of the harness fabrication apparatus of FIG. 1 is adapted to handle wire pairs individually and selectively. That is, mass-terminating station of FIG. 5 can terminate any preselected subplurality of wire pairs; lasher 41 of FIG. 12 can selectively lash together any preselected subpluralities of wire pairs; and, finally, the cutter head of FIG. 13 can selectively sever any subplurality of wire pairs. The capability of arbitrary selection of wire pairs permits the apparatus of FIG. 1 to be used with any desired harness configuration, requiring only a change in the control sequence of master sequencer 28 and movement of block holding devices 16 to adapt the various operating stations to a new harness configuration. This selectivity is important in a commercial wiring harness fabrication process where requirements for new harness configurations may be changing rapidly and it is undesirable to close down the entire production line in order to rework the harness configuration. With the complete selectivity provided by the present invention, it is merely necessary to feed in new sequences of connector blocks at station 20, lower different presser heads 27 at the mass-terminating station 21, lash different subsets of wire pairs at lashing station 22, and finally sever new subpluralities of wire pairs at cutter station 23. Each of these functions can be altered by altering master sequencer 28 and need not involve any adjustments whatsoever at the operating stations.

We claim:

1. Apparatus for fabricating wiring harnesses in a continuous stream comprising:

a movable carrier;

a plurality of connector block holding devices affixed to said carrier;

a connector block insertion station disposed along said carrier for selectively inserting connector blocks of varying sizes in preselected positions transverse to said carrier;

a mass-terminating station for selectively connecting electrical wires to connector blocks in said holding devices, said mass-terminating station being disposed along said carrier downstream from said insertion station;

a wire lashing station for selectively lashing subpluralities of said electrical wires into bundles, said lashing station being disposed along said carrier downstream from said mass-terminating station;

a wire cutting station for selectively cutting subpluralities of said electrical wires, said cutting station being disposed along said carrier downstream from said lashing station; and control means for moving said carrier to sequentially carry said holding devices to each of said stations.

2. The harness fabrication apparatus according to claim 1 wherein said mass-terminating station comprises:

means for securing the orientation of a plurality of electrical wires in parallel relationship and in a common plane; and selectively activated terminating heads for selectively connecting planar oriented electrical wires to individual connectors in each said connector block.

3. The harness fabrication apparatus according to claim 2 wherein said orientation securing means comprises:

an indexing head for securing the alignment of said electrical wires at a first position; and a comb structure for extending said aligned wires for a distance beyond said indexing head.

4. The harness fabrication apparatus according to claim 3 wherein said indexing head comprises a plurality of freely rotating cylinders having a pair of threadways axially disposed therein;

means for locking each of said cylinders to provide a preselected orientation of said threadways; and means for supplying the wires of each of a plurality of twisted pairs into the threadways in a respective one of said cylinders.

5. The harness fabrication apparatus according to claim 3, wherein said comb structure comprises:

a plurality of retractable teeth, means for extending said teeth between the wires at said indexing head; and means for moving said teeth laterally away from said indexing head.

6. The harness fabrication apparatus according to claim 2 wherein said terminating heads each comprise:

a presser head individually and selectively extendable to force, when extended, individual ones of said planar oriented wires into individual connectors in said connector block.

7. The harness fabrication apparatus according to claim 2 further including a supply of insulated electrical wires and means for supplying said wires to said orientation securing means.

8. The harness fabrication apparatus according to claim 7 wherein said electrical wires comprise twisted pairs.

9. The harness fabrication apparatus according to claim 1 wherein said wire cutting station comprises a plurality of cutting heads, each of which, when operated, is adapted to cut electrical wires at one of said connector blocks.

10. The harness fabrication apparatus according to claim 9 wherein each of said cutter heads includes means for selectively cutting said electrical wires on either the downstream or upstream side of a connector block.

11. An electrical harness making machine comprising:

a linearly movable carrier for electrical connector blocks having a plurality of electrical connectors transversely disposed thereon and longitudinally displaced along said carrier by distances corresponding to their relative positions in said electrical harness;

a source of linearly extending planar oriented electrical wires;

means for selectively terminating each of said wires in preselected ones of said connectors; and means for selectively cutting each of said wires adjacent to the connected ones of said connectors.

12. An electrical harness making machine for twisted wire pairs comprising:

a linearly movable carrier for electrical connector blocks each having a plurality of electrical connectors transversely disposed thereon and longitudinally displaced from each other along said carrier by distances corresponding to their relative positions in said electrical harness;

a source of twisted pairs of linearly extending planar oriented electrical wires;

pair indexing means for indexing the members of each of said pair in said planar orientation; and pair terminating means for connecting only selected ones of said pairs of electrical wires to said electrical connectors.

13. The electrical harness making machine according to claim 12 wherein each said electrical connector comprises a slotted beam registered with one of said electrical wires.

14. A method of fabricating electrical harnesses comprising the steps of:

selectively connecting subpluralities of parallel electrical wires to linearly disposed transverse electrical connectors separated by distances corresponding to their final positions in a finished electrical harness;

selectively lashing subpluralities of said electrical wires at lashing points between said linearly disposed electrical connectors; and selectively cutting said wires adjacent to connected ones of said electrical connectors.

15. The method of fabricating electrical harnesses according to claim 14 further comprising:

moving said electrical connectors along a linear path; and simultaneously performing said connecting, lashing and cutting steps on different ones of said connectors at different locations along said linear path.

16. A method of fabricating electrical harnesses using twisted pairs of electrical wires comprising the steps of:

linearly disposing a plurality of electrical connectors in positions corresponding to their final positions in said electrical harness;

selectively indexing the members of twisted pairs of wires in a common plane;

selectively terminating the wires of the indexed pairs in said electrical connectors;

selectively lashing said twisted pairs of electrical wires at each said connector and at each branching point of said electrical harness; and selectively cutting each of said wires on the side of said connectors away from said harness.

17. An automatic method of making electrical wiring harnesses in a continuous stream comprising the steps of:

moving a plurality of spaced electrical connector blocks along a linear path, said connectors being spaced apart by distances corresponding to their separation in a finished electrical harness;

mass-terminating electrical wires in selected connectors of said connector blocks;

lashing said electrical wires into bundles on the harness side of each of said connectors and at each branching point in said wiring harness; and cutting said electrical wires on the side of each of said connectors away from said harness side.

18. The method of making wiring harnesses according to claim 17 further including the steps of:

aligning said electrical wires in parallel in a common plane in registry with the connectors of said connector blocks; and selectively forcing each wire into electrical contact with the registered connector.

19. The method of making wiring harnesses according to claim 18 wherein said step of aligning further comprises the steps of:

indexing the wires of twisted pairs of wires in said common plane; and combing said indexed wires in said common plane across the connectors of said connector block.

* * * * *